United States Patent [19]

Iser

[11] 4,333,682

[45] Jun. 8, 1982

[54] SPACE CASE DRUMMERS THRONE COMBINATION

[76] Inventor: George H. Iser, 94-06 82nd Pl., Ozone Park, N.Y. 11416

[21] Appl. No.: 177,950

[22] Filed: Aug. 14, 1980

[51] Int. Cl.[3] ..... A47C 7/62

[52] U.S. Cl. ..... 297/192; 190/8; 312/235 R; 312/250

[58] Field of Search ..... 297/217, 349, 192, 193, 297/338; 190/8, 6, 18 A; 108/33; 312/235 R; 248/407

[56] References Cited

U.S. PATENT DOCUMENTS

| | | | |
|---|---|---|---|
| 137,738 | 4/1873 | Trevitt | 312/235 R |
| 504,460 | 9/1893 | Snider | 297/349 X |
| 530,469 | 12/1894 | Boyd | 190/8 |
| 603,618 | 5/1898 | Banes | 312/235 R |
| 1,203,572 | 11/1916 | Betts | 297/338 X |
| 1,264,474 | 4/1918 | Baker | 312/235 R |
| 1,280,891 | 10/1918 | Stansel | 312/235 R |
| 2,568,534 | 9/1951 | Baker | 108/33 |
| 2,919,138 | 12/1959 | Brower et al. | 190/18 A |
| 2,925,283 | 2/1960 | Stilger | 190/18 A |

FOREIGN PATENT DOCUMENTS

| | | | |
|---|---|---|---|
| 370958 | 1/1907 | France | 248/407 |

*Primary Examiner*—James T. McCall
*Attorney, Agent, or Firm*—Richard L. Miller

[57] ABSTRACT

A drummer's storage case; the device including a hollow box, a front hinged door, a handle on the side, casters or wheels on the other side and an adjustable, removable seat assembly that is stored inside the box while the case can be easily moved when travelling.

2 Claims, 4 Drawing Figures

SPACE CASE DRUMMERS THRONE COMBINATION

BACKGROUND OF THE INVENTION

This invention relates generally to cases for storage. More specifically it relates to storage cases with adjustable, removable seats that are used by drummers.

It is generally well known that when a musician such as a drummer has to travel he must carry his drums with him. He also has to have a seat to sit on when he plays the drums. He then has to carry separately both his drums and seat with him. This situation is therefore in need of an improvement.

SUMMARY OF THE INVENTION

Accordingly it is a principal object of the present invention to provide a storage case with a built-in seat assembly.

Another object is to provide easy removal of the seat assembly and it's storage in the case.

Yet another object is to provide an easy way of moving the storage case when travelling.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DESCRIPTION OF THE PREFERRED EMBODIMENT

Figure 1:
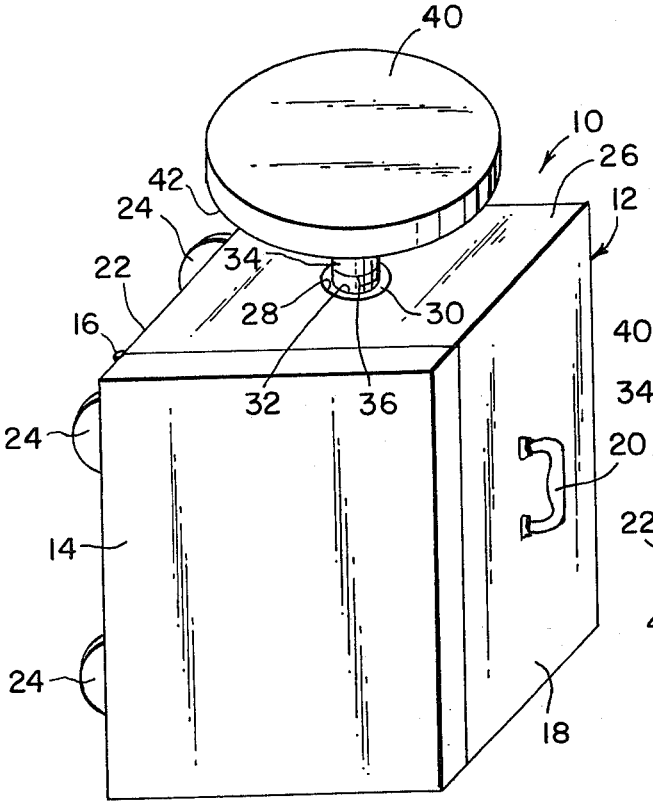
FIG. 1 is a perspective view of the invention.

Referring now to the drawing in greater detail, the reference numeral 10 represents a storage case and seat assembly according to the present invention wherein there is a hollow box 12 having on the front a door 14 hinged at 16 to side 22. The door can have a locking device (not shown). On one side 18 is a handle 20 centrally mounted and on the other side 22 a set of casters or wheels 24.

Figure 3:
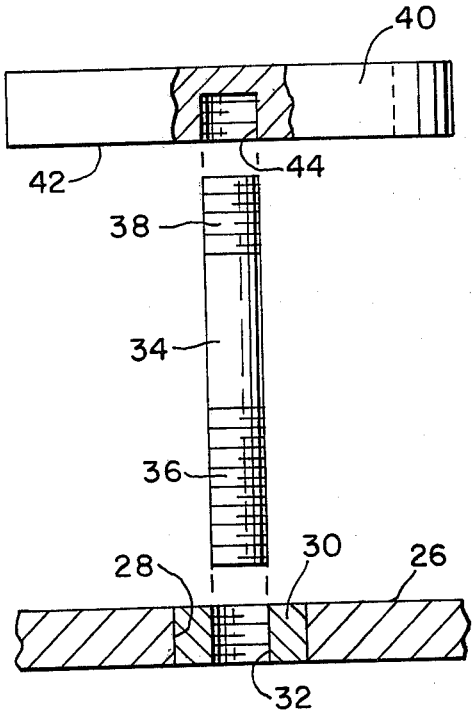
FIG. 3 is an exploded view of parts in section of the seat assembly of the invention.

The seat assembly is best seen in FIG. 3. The top wall 26 of box 12 has a central aperture 28 with a ring 30 having a central threaded aperture 32 force fitted into aperture 28.

A vertical shaft 34 is threaded at end 36 and threads into aperture 32. The other end 38 of shaft 34 is threaded. The seat 40 has on the bottom 42, a central threaded aperture 44 that threads on end 38 of shaft 34. The seat 40 can then be adjusted in height by a screwing the threaded end 36 of the shaft 34 up or down in the threaded aperture 32 of the ring 30, or be removed completely from the top 26 and placed inside the storage box 12 with the shaft 34.

Figure 2:
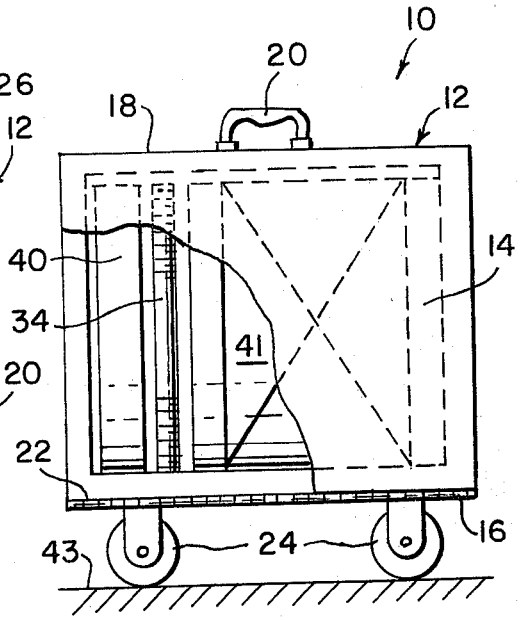
FIG. 2 is a side elevation view of the invention with the seat and drum inside and door broken away.

FIG. 2 shows the storage box 12 in a position for travel. The seat 40 and shaft 34 are removed and placed inside storage box 12 with drum 41. The box 12 is turned so side 22 is on bottom with casters 24 on ground or floor 43. Handle 20 is now on top to be held by hand.

Figure 4:
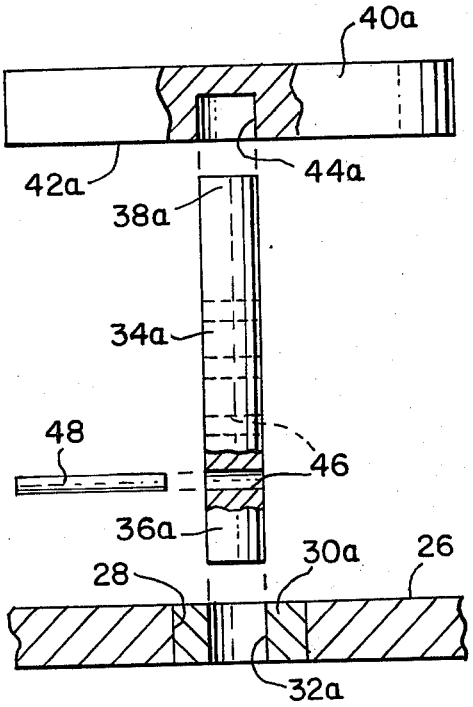
FIG. 4 is an exploded view of parts in section of a modified form of the invention.

FIG. 4 is a modified form of the seat assembly. The top wall 26 of box 12 has a central aperture 28, with a ring **30*a* having a central aperture 32*a*, force fitted into aperture 28. A vertical shaft 34*a* has a plurality of horizontal holes 46. A pin 48 slides into any one hole 46 for adjustment and the plain end 36*a* of shaft 34*a* fits into aperture 32*a* of ring 30*a*. The seat 40*a* has on the bottom 42*a* a central aperture 44*a* that fits on plain end 38*a* of shaft 34*a*. The seat 40*a* can also be adjusted in height by placing pin 48 in a different hole 46 in shaft 34*a* or can be removed completely from the top 26 and placed inside the storage box 12 with shaft 34*a* and pin 48**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A storage case, comprising in combination a hollow box, a hinged door on the front of said box, a handle at one side of said box, a plurality of casters at the other side of said box, and an adjustable, removable seat assembly at the top of said box, wherein said top of said box comprises a central aperture, and a ring with a central threaded aperture placed into said top aperture and wherein said seat assembly comprises a seat with a bottom central threaded partial aperture and a vertical shaft threaded on both ends that threads into said bottom of said seat and into said top of said box.

2. A storage case, comprising in combination a hollow box, a hinged door on the front of said box, a handle at one side of said box, a plurality of casters at the other side of said box, and an adjustable, removable seat assembly at the top of said box, wherein said top of said box comprises a central aperture and a ring with a central aperture placed into said top aperture and wherein said seat assembly comprises a seat with a bottom central partial aperture, a vertical shaft that fits into said bottom of said seat, said shaft having a plurality of horizontal holes and a pin that slides into any one said hole on said shaft that fits into said top of said box.

* * * * *